US010602891B1

(12) United States Patent
Kislin

(10) Patent No.: US 10,602,891 B1
(45) **Date of Patent: *Mar. 31, 2020**

(54) TOILET SEAT AND LID ASSEMBLY INCLUDING AN AUTOMATICALLY-LIFTABLE TOILET SEAT

(71) Applicant: Albert Alex Kislin, Parkland, FL (US)

(72) Inventor: Albert Alex Kislin, Parkland, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/293,860

(22) Filed: Oct. 14, 2016

Related U.S. Application Data

(60) Provisional application No. 62/241,824, filed on Oct. 15, 2015.

(51) Int. Cl.
*A47K 13/10* (2006.01)
*A47K 13/24* (2006.01)

(52) U.S. Cl.
CPC ..... *A47K 13/10* (2013.01); *A47K 13/242* (2013.01)

(58) Field of Classification Search
CPC ..... A47K 13/04; A47K 13/10; A47K 13/12; A47K 13/24; A47K 13/242; A47K 13/245; A47K 13/247
USPC ..... 4/246.1–246.5, 248, 241
See application file for complete search history.

(56) References Cited

U.S. PATENT DOCUMENTS 2,431,263 A * 11/1947 Lundgren ..... A47K 13/12 16/327
2,812,522 A * 11/1957 Wilson ..... A47K 13/10 16/305
3,825,958 A * 7/1974 Higginson ..... A47K 13/10 4/240
4,296,504 A * 10/1981 Lawson ..... A47K 13/242 4/253
4,426,743 A * 1/1984 Seabrooke ..... A47K 13/10 4/241
4,766,619 A * 8/1988 Takeda ..... A47K 13/10 4/246.1

(Continued)

FOREIGN PATENT DOCUMENTS

GB 2308615 A * 7/1997 ..... A47K 13/242
WO WO 2017065814 A1 * 4/2017 ..... A47K 13/10

OTHER PUBLICATIONS

Written Opinion of the International Searching Authority of related application WO 2017065814.*
Search Report of related application WO 2017065814.*

*Primary Examiner* — Erin Deery
(74) *Attorney, Agent, or Firm* — John Rizvi; John Rizvi, P.A.-The Patent Professor®

(57) ABSTRACT

A toilet seat and lid assembly includes a toilet lid. A toilet seat is pivotally carried by the toilet lid. A seat raising mechanism includes a lock housing rotatable between a lowered seat position and a raised seat position, a lock pin cavity in the lock housing, a spring-loaded lock pin disposed for displacement in the lock pin cavity between a locking position and an unlocking position, a seat bracket engaged for rotation by the lock housing and engaging the toilet seat and a torsion spring normally biasing the lock housing in the lowered seat position. A pin actuating rod is carried by the toilet lid. The pin actuating rod engages the lock pin for actuation of the lock pin from the locking position to the unlocking position. A seat actuation button is carried by the toilet lid and engages the pin actuating rod.

9 Claims, 10 Drawing Sheets

(56) References Cited

U.S. PATENT DOCUMENTS

| | | | | |
|---|---|---|---|---|
| 4,780,914 | A * | 11/1988 | Lin | A47K 13/10 16/298 |
| 8,006,323 | B1 * | 8/2011 | Potter | A47K 13/10 4/241 |
| 2013/0117918 | A1 * | 5/2013 | Tian | A47K 13/12 4/236 |

* cited by examiner

TOILET SEAT AND LID ASSEMBLY INCLUDING AN AUTOMATICALLY-LIFTABLE TOILET SEAT

CROSS-REFERENCE TO RELATED APPLICATION

This application claims the benefit of U.S. Provisional Patent Application Ser. No. 62/241,824, filed Oct. 15, 2015, which is incorporated herein in its entirety.

FIELD OF THE INVENTION

The present invention relates generally to toilets, and more particularly, to a toilet seat and lid assembly having a toilet seat which can be automatically lifted without a user having to touch the toilet seat with his or her hand.

BACKGROUND OF THE INVENTION

Toilets are typically fitted with a toilet seat and a toilet lid which are hinged to the rear rim of a toilet bowl. Typically, users are required to raise and lower toilet seats and toilet lids manually, by grasping the toilet seat or lid with their hand and applying an upward or downward force to cause them the toilet seat or lid to pivot about the hinge axis.

Generally, female users utilize a toilet with the toilet seat in a lower position, in order to sit on the toilet seat. Male users, instead, normally utilize the toilet with the toilet seat in either the lower position or the raised position, in dependence of their physiological needs. Of course, users in general, regardless of their gender, may wish to lower or raise the toilet seat for any applicable reason, such as for cleaning the toilet.

Toilet lids and, especially, toilet seats may often become unclean with use. Because of this, users may not want to touch the toilet lid or toilet seat with their own hands. In the particular case in which a male user does not wish to manually raise a lowered toilet seat, the male user may end up urinating from a standing position with the toilet seat in the lowered position, very likely splashing the upper surface of the toilet seat. This may annoy other users of the toilet, and particularly female users who wish to sit on the toilet seat.

Accordingly, there is an established need for a toilet seat and lid assembly having a toilet seat which can be automatically lifted without a user's having to touch the toilet seat with his or her hands.

SUMMARY OF THE INVENTION

The present invention is directed to a toilet seat and lid assembly having a toilet seat which can be automatically lifted without a user having to touch the toilet seat with his or her hands. The toilet seat and lid assembly is configured to be mounted on a toilet bowl, and includes a toilet lid pivoted to a toilet seat, a seat raising mechanism and a button on the toilet lid which actuates the seat raising mechanism when depressed. The seat raising mechanism pivots the toilet seat from a lowered seat position to a raised seat position on the toilet bowl. Preferably, the toilet seat can also be manually raised.

In an illustrative embodiment of the invention, a toilet seat and lid assembly includes a toilet lid, a toilet seat pivotally arranged with respect to the toilet lid, and a seat raising mechanism. The seat raising mechanism includes a lock housing rotatable between a lowered seat position and a raised seat position, a lock pin cavity in the lock housing, a spring-loaded lock pin disposed for displacement in the lock pin cavity between a locking position and an unlocking position, a seat bracket engaged for rotation by the lock housing and engaging the toilet seat, and a torsion spring biasing the lock housing towards the raised seat position. The toilet seat and lid assembly further includes a pin actuating rod carried by the toilet lid, the pin actuating rod engaging the lock pin for actuation of the lock pin from the locking position to the unlocking position. A seat actuation button is carried by the toilet lid and engages the pin actuating rod.

In a second aspect, the seat raising mechanism can be contained inside a base element between the toilet seat and the toilet lid.

In another aspect, a lock pin compression spring can bias the lock pin in the locking position in the lock pin cavity.

In yet another aspect, the lock pin can be mounted on a pin axle which extends through an elongated axle slot in the lock pin.

In still another aspect, the seat actuation button can engage a button rod which engages a rod link pivoted to the pin actuating rod.

In a still further aspect, a cover can conceal the pin actuating rod, the rod link and the button rod on the toilet lid.

In another aspect, the torsion spring can be mounted between a spring mount and a spring retainer which extends from the lock housing.

In still another aspect, the spring mount can have multiple spring mount teeth which mesh with companion side support teeth on a side support of the seat raising mechanism.

Disclosed is a seat lifting mechanism for lifting a toilet seat without touching the toilet seat, the seat lifting mechanism comprising, a base configured to rotate a toilet seat between a lowered seat position and a raised seat position, where the toilet seat may be biased to the raised position and selectively lockable in the lowered position. The toilet seat may be spring biased to the raised position, and the toilet seat may be selectively lockable in the lowered position. The seat lifting mechanism includes an actuation structure that may be selectively displaceable to cause the toilet seat to become released from the lowered position to be rotated to the raised position due to the spring bias. The seat lifting mechanism includes a toilet lid, and the actuation structure may be displaceable upon actuating an actuation button disposed on the toilet lid. The actuation structure includes a pin that may be configured to lock into an opening in the base for locking the toilet seat in the lowered position. The seat lifting mechanism includes at least one damper for dampening a rotational force applied by the seat when the seat is rotated between the lowered position and the raised position and between the raised position and the lowered position.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a toilet seat and lid assembly having a toilet seat which can be automatically lifted without a user's having to touch the toilet seat with his or her hands. The embodiment shown in the figures further allows the user to manually lift the toilet seat if desired.

Figure 1:
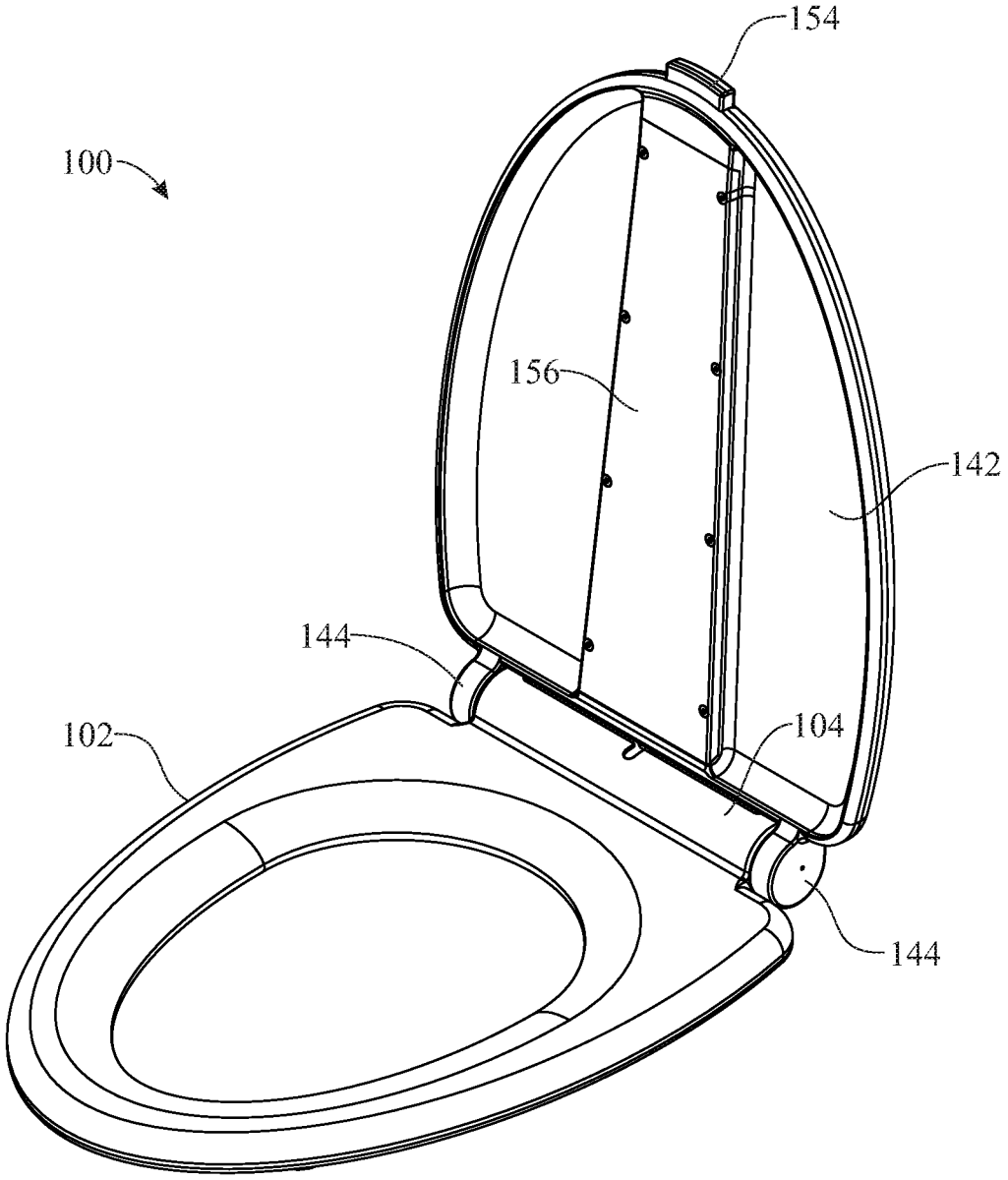
FIG. 1 presents a front top perspective view of an illustrative embodiment of the toilet seat and lid assembly with the toilet lid in a raised position and the toilet seat in a lowered position.
Figure 2:
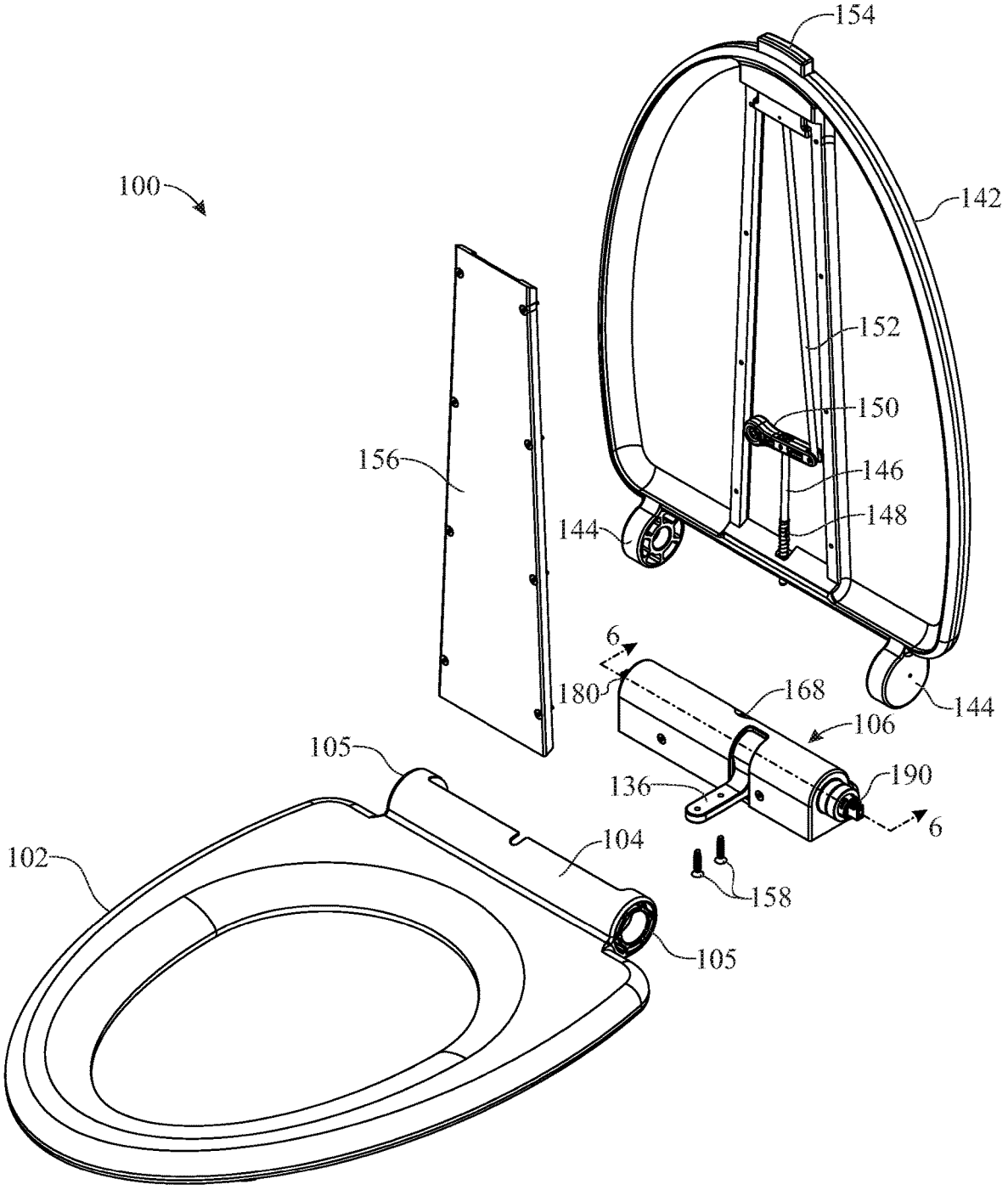
FIG. 2 presents an exploded front top perspective view of the toilet seat and lid assembly.
Figure 3:
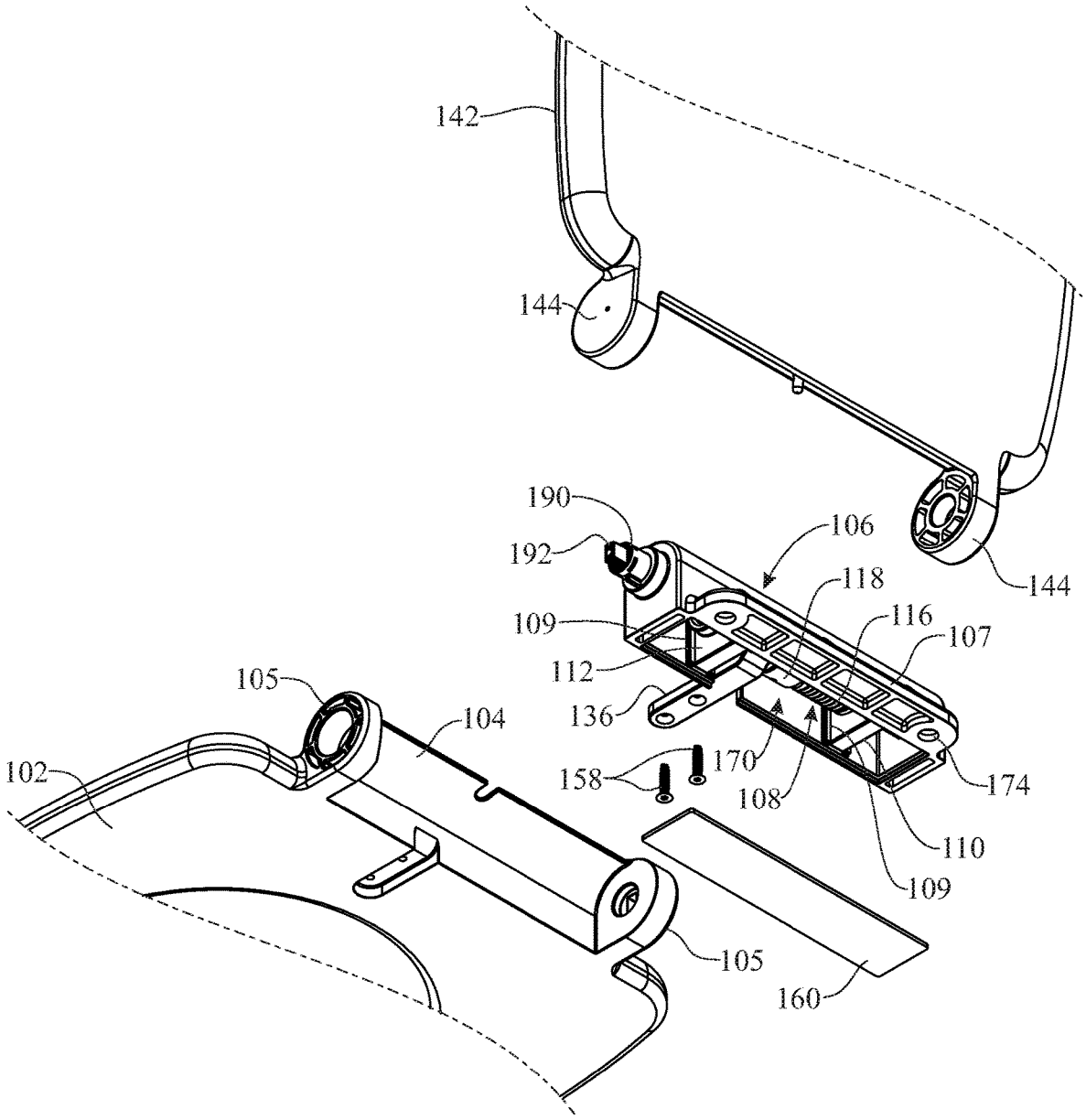
FIG. 3 presents an enlarged exploded rear bottom perspective view of the toilet seat and lid assembly, with the toilet lid and the toilet seat shown only partially.
Figure 4:
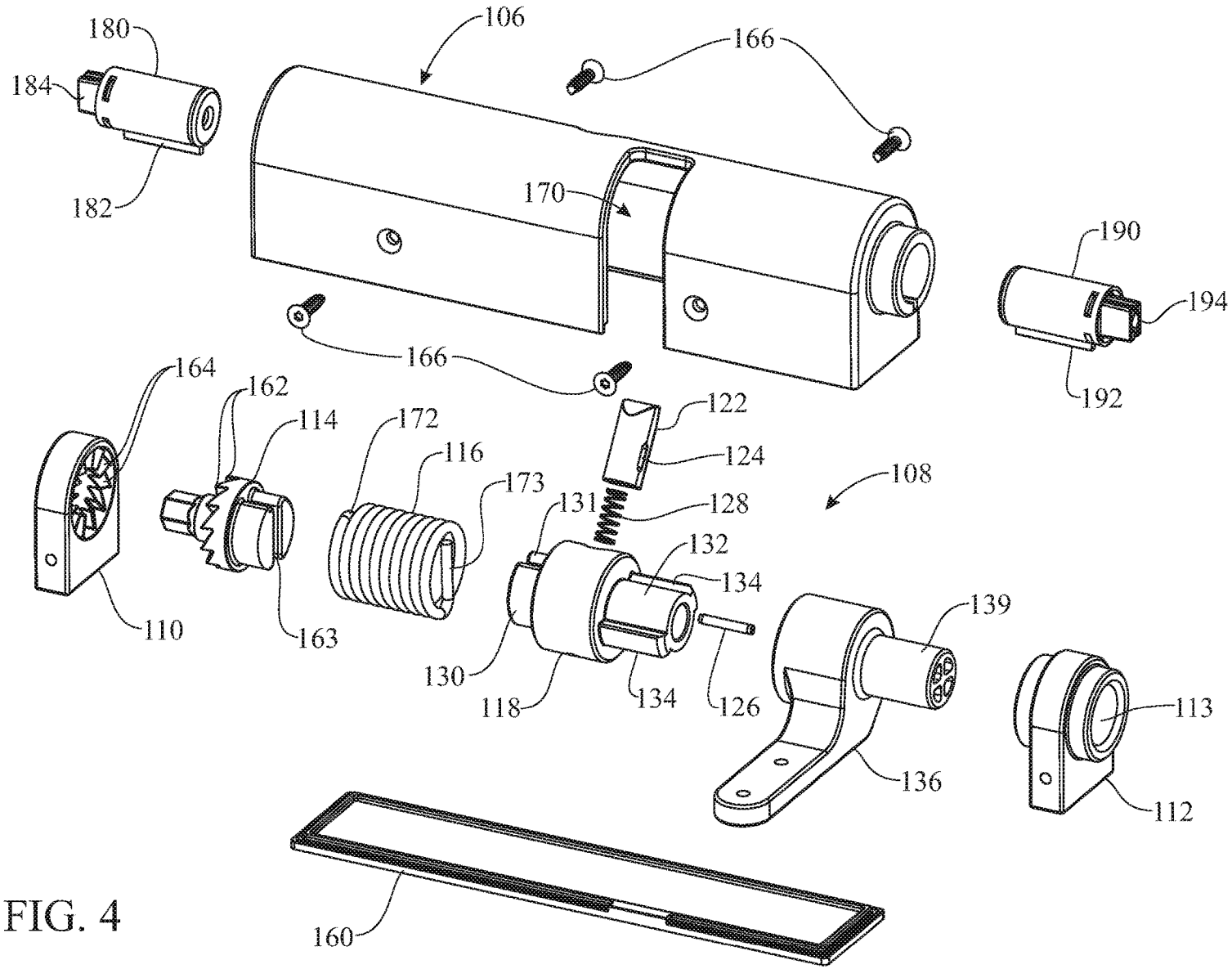
FIG. 4 presents an exploded front top perspective view of the base element of the toilet seat and lid assembly, revealing the seat raising mechanism of the toilet seat and lid assembly.
Figure 5:
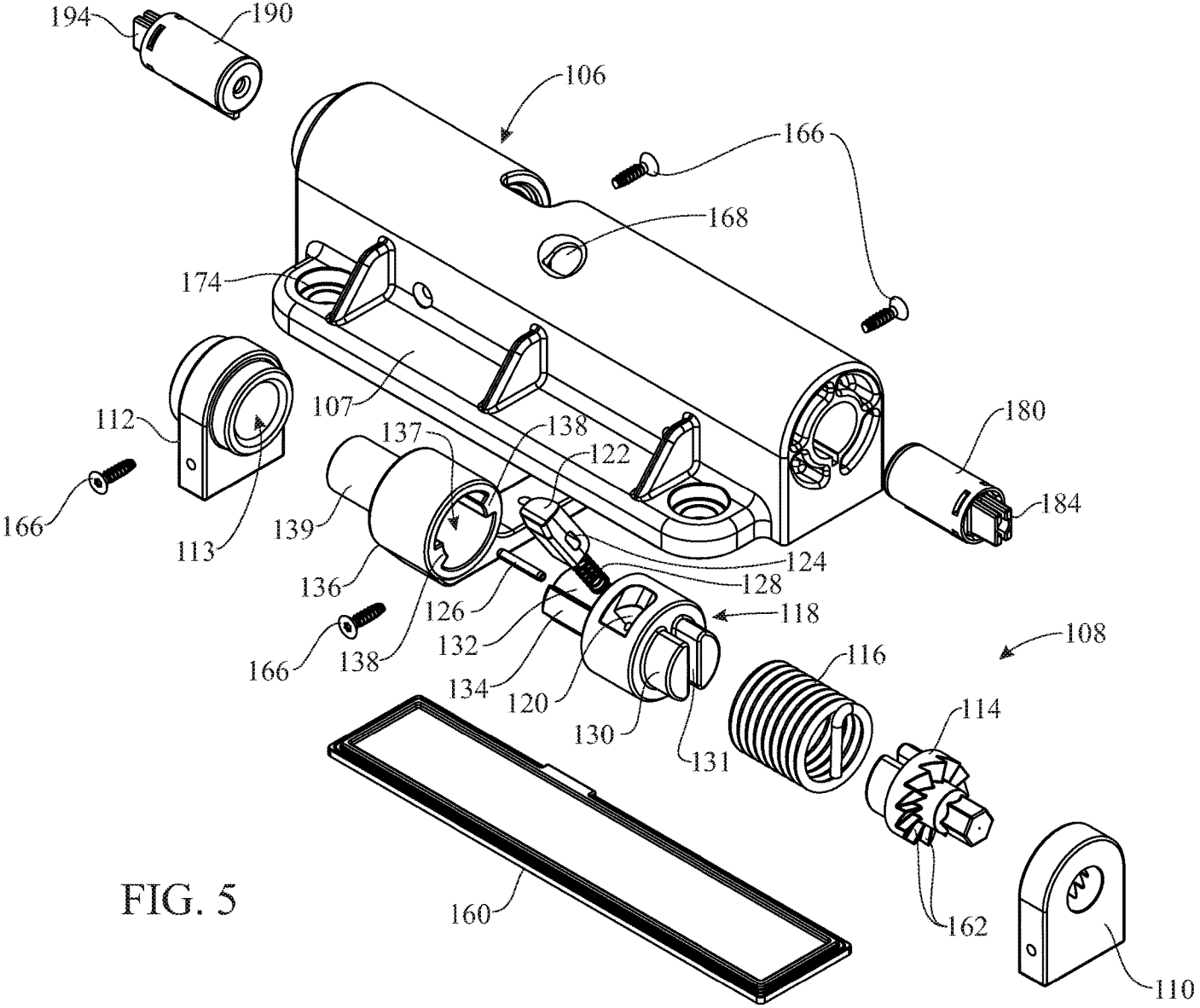
FIG. 5 presents an exploded top rear perspective view of the base element of the toilet seat and lid assembly.

Referring initially to FIGS. 1 through 5, a toilet seat and lid assembly 100 is illustrated in accordance with an exemplary embodiment of the present invention. The toilet seat and lid assembly 100 is essentially comprised of a toilet seat 102 and a toilet lid 142, which are shown in FIG. 1 and are pivotable relative to one another and to a toilet bowl (not shown), and an elongated base element 106 which is revealed in the exploded view of FIG. 2. As best shown in FIGS. 2 and 3, an elongated toilet seat flange 104 may extend along a rear edge of the toilet seat 102. The toilet lid 142 may be pivotally mounted on the toilet seat flange 104. A pair of spaced-apart toilet lid flanges 144 can extend from the toilet lid 102. The toilet lid flanges 144 can be pivotally attached to the respective ends of the toilet seat flange 104. In turn, the elongated base element 106 is mounted in a cavity delimited by the toilet seat flange 104 and two side portions 105. As illustrated in FIGS. 3 and 5, in some embodiments, a base element mount flange 107 may extend from the base element 106, to facilitate attaching the entire toilet seat and lid assembly 100 to a toilet (not shown). A base element bottom cover 160 may be mounted on the bottom of the base element 106 to enclose an elongated interior space 170 of the base element 106.

A seat raising mechanism 108 is contained within the base element 106. As illustrated in FIGS. 3 through 6, the seat raising mechanism 108 may include a first side support 110 and a second side support 112. As best shown in FIG. 3, the first side support 110 and the second side support 112 are snugly fitted into a respective receiving channel 109 on an internal surface of the base element 106 and arranged in a transverse position within the elongated interior space 170 of the base element 106. The first and second side supports 110, 112 are attached to the base element 106 by screws 166 (FIGS. 4 and 5). As shown in FIG. 4, the first side support 110 may include a non-rotational connection, such as but not limited to multiple side support teeth 164. A spring mount 114 may be inserted in and supported by the first side support 110. The spring mount 114 is non-rotationally coupled to the first side support 110, for which the spring mount 114 is provided with a mating non-rotational connection to that of the first side support 110, such as but not limited to spring mount teeth 162 which mesh with the side support teeth 164 of the first side support 110. A first end of a coiled torsion spring 116 may engage the spring mount 114 in a non-rotating manner; for instance, a first end 172 of the torsion spring 116 can non-rotationally fit into an end slot 163 of the spring mount 114.

Figure 6:
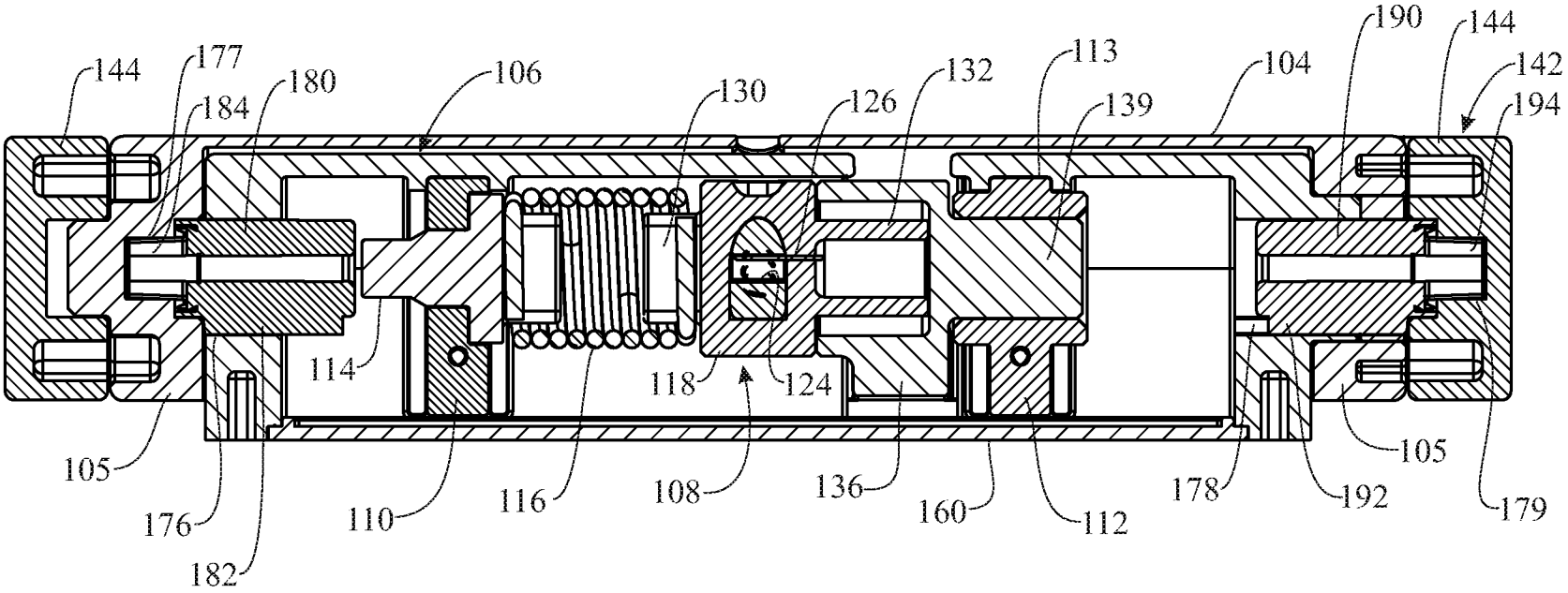
FIG. 6 presents a longitudinal cross-sectional view of the base element with the seat raising mechanism mounted inside the base element, taken along section plane 6-6 indicated in FIG. 2.

With continued reference to FIG. 4, the seat raising mechanism 108 may further include a lock housing 118 which is disposed for rotation between a lowered seat position and a raised seat position within the elongated interior space 170 of the base element 106. As illustrated in FIGS. 4 through 6, a spring retainer 130 and a seat bracket engaging neck 132 may extend from opposite ends of the lock housing 118. The spring retainer 130 may engage a second end of the torsion spring 116 in a non-rotating manner; for instance, an end slot 131 of the spring retainer 130 can receive a second end 173 of the torsion spring 116. The torsion spring 116 is configured to normally bias the lock housing 118 towards the raised seat position. The seat bracket engaging neck 132 may have a pair of protrusions or neck flanges 134 for purposes which will be hereinafter described.

Figure 7A:
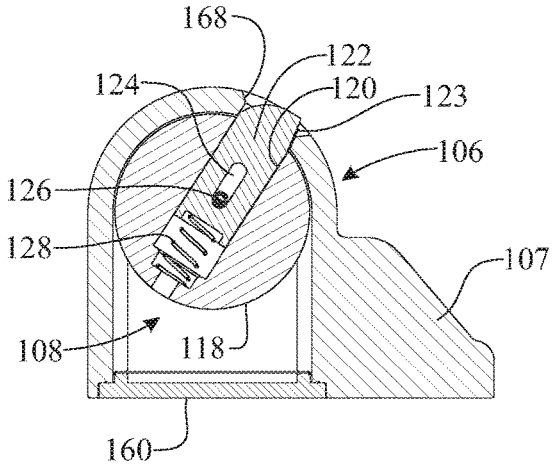
FIG. 7A presents a transverse cross-sectional view of the base element and seat raising mechanism with the lock pin illustrated in a locking position in a lock housing of the mechanism.
Figure 7B:
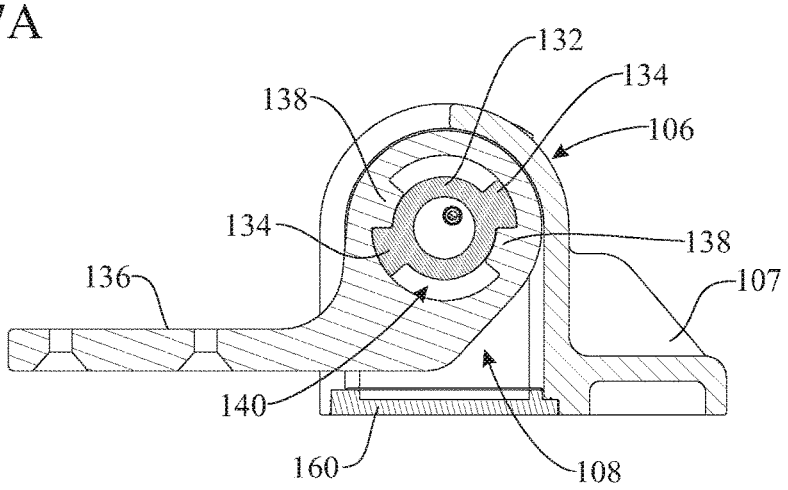
FIG. 7B presents a transverse cross-sectional view of the base element and seat bracket with the seat bracket in a lowered position.

As illustrated in FIGS. 4, 5, 7A and 8A, a lock pin cavity 120 may extend into the lock housing 118 in a radial orientation. A lock pin opening 168 may be provided in the base element 106. When the lock housing 118 is in the lowered seat position, as illustrated in FIGS. 7A and 7B, the lock pin cavity 120 communicates with the lock pin opening 168. When the lock housing 118 is in the raised seat position in the lock pin cavity 120, the lock pin cavity 120 is misaligned with the lock pin opening 168.

A lock pin 122 is disposed for sliding displacement between a locking position (FIG. 7A) and an unlocking position (FIG. 8A) in the lock pin cavity 120. The lock pin 122 may have a beveled lock pin surface 123 for purposes which will be hereinafter described. A lock pin compression spring 128 may be provided in the lock pin cavity 120 to normally bias the lock pin 122 to the locking position. In the locking position of the lock pin 122 (FIG. 7A), the lock pin 122 protrudes from the lock pin cavity 120 into the lock pin opening 168 to lock the lock housing 118 in the lowered seat position against the bias imparted by the torsion spring 116. In the unlocking position of the lock pin 122 (FIG. 8A), the lock pin 122 is retracted in the lock pin cavity 120 and clears the lock pin opening 168, facilitating rotation of the lock housing 118 from the lowered seat position to the raised seat position responsive to the bias imparted by the torsion spring 116. In some embodiments, a pin axle 126 may be provided in the base element 106, secured to inner walls of the lock housing 118. The pin axle 126 may extend through an elongated axle slot 124 in the lock pin 122, to limit and guide the translation of the lock pin 122 through the lock pin cavity 120.

The seat raising mechanism 108 may further include a seat bracket 136 which is fixedly attachable to the toilet seat 102 typically via a pair of seat bracket fasteners 158 (FIG. 3). As best shown in FIG. 5, a first end of the seat bracket 136 comprises a receiving cavity 137 and two internal protrusions 138. On an opposite, second end the seat bracket 136 ends in a cylindrical neck 139, which is configured to rotationally engage with an opening 113 in the second side support 112. The seat bracket engaging neck 132 of the lock housing 118 is configured to be inserted into the receiving cavity 137 of the seat bracket 136, and may drivingly engage the seat bracket 136 for rotation through the neck flanges 134 contacting and angularly pushing the protrusions 138. Accordingly, upon rotation of the lock housing 118 from the lowered seat position to the raised seat position, the seat bracket 136 raises the toilet seat 102.

As illustrated in FIG. 4, a first damper 180 and a second damper 190 may be provided in opposite ends of the base element 106 at the junction between the base element 106 and the side portions 105 adjacent the toilet seat flange 104. The first damper 180 comprises a generally cylindrical body having a protruding, longitudinal rib 182 and an end portion 184. The end portion 184 and the longitudinal rib 182 are rotatable relative to one another along a longitudinal axis of the first damper 180, the relative rotation being dampened by internal mechanisms to the first damper 180 that will not be explained in greater detail so as not to obscure the present disclosure. Similarly, the second damper 190 comprises a generally cylindrical body having a protruding, longitudinal rib 192 and an end portion 194 which are rotatable relative to one another in a dampened fashion. As best shown in FIG. 6, the longitudinal rib 182 of the first damper 180 is non-rotationally inserted into a corresponding slot 176 on a side of the base element 106; in turn, the end portion 184 of the first damper 180 is non-rotationally coupled to a receiving recess 177 in a side portion 105 of the toilet seat flange 104. In consequence, the first damper 180 dampens the relative rotation between the base element 106 and the toilet seat 102. In turn, the longitudinal rib 192 of the second damper 190 is non-rotationally inserted into a corresponding slot 178 on an opposite side of the base element 106; in turn, the end portion 194 of the second damper 190 is non-rotationally coupled to a receiving recess 179 in a toilet lid flange 144. In consequence, the second damper 190 dampens the relative rotation between the base element 106 and the toilet lid 142.

As illustrated in FIG. 2, a pin actuating rod 146 may be mounted for reciprocation between a pin actuating position and a pin release position on the toilet lid 142. A rod return spring 148 may normally bias the pin actuating rod 146 to the pin release position. In the pin actuating position, the pin actuating rod 146 extends into the lock pin opening 168 in the base element 106 and depresses the lock pin 122 in the lock pin cavity 120 from the locking position (FIG. 7A) to the unlocking position (FIG. 8A) against the bias imparted by the rod return spring 148 and the lock pin compression spring 128. In the pin release position, the rod return spring 148 releases the lock pin 122 such that the lock pin compression spring 128 returns the lock pin 122 from the unlocking position (FIG. 8A) to the locking position (FIG. 7A) and prevents the torsion spring 116, lock housing 118 and seat bracket 138 from automatically raising the toilet seat 102.

As further illustrated in FIG. 2, the pin actuating rod 146 can pivotally engage a rod link 150. A button rod 152 may pivotally engage one end of the rod link 150, while the opposite end of the rod link 150 can be rotatable attached to the toilet lid 142. A seat actuation button 154 may be provided on the toilet lid 142, such as at a front edge thereof. The seat actuation button 154 may engage the button rod 152. Accordingly, upon depression, the seat actuation button 154 pushes the button rod 152, which in turn pivots the rod link 150, actuating the pin actuating rod 146 from the pin release position to the pin actuating position against the bias imparted by the rod return spring 148. In consequence, as explained heretofore, the pin actuating rod 146 extends into the lock pin opening 168 in the base element 106 and depresses the lock pin 122 from the locking position (FIG. 7A) to the unlocking position (FIG. 8A) against the bias imparted by the lock pin compression spring 128. Thus, the lock housing 118 is freed to rotate, forced by the torsion spring 116, from the lowered seat position to the raised seat position. As illustrated in FIGS. 1 and 2, a cover 156 may be attached to the toilet lid 142 to cover or enclose and conceal the pin actuating rod 146, the rod link 150 and the button rod 152.

In typical application, the toilet seat and lid assembly 100 may be mounted on the rear edge (not illustrated) of a toilet bowl such as by extending fasteners (not illustrated) through fastener openings 174 in the base element mount flange 107 on the base element 106. As illustrated in FIG. 7A, the lock pin compression spring 128 normally biases the lock pin 122 in the locking position such that the lock pin 122 extends from the lock pin cavity 120 in the lock housing 118 into the registering lock pin opening 168 in the base element 106 to prevent relative rotation between the lock housing 118 and the base element 106 and to thus secure the lock housing 118 and the toilet seat 102 in the lowered position on the toilet bowl, against the torsion applied by the torsion spring 116. The illustration of FIG. 7B (which is the same as the illustration of FIG. 8B) shows another cross-sectional view taken also when the toilet seat and lid assembly 100 is in the position of FIG. 7A. As shown, when the lock pin 122 is in the locking position and the seat bracket 136 is in the lowered position, the protrusions 138 of the seat bracket 136 are arranged rotationally advanced (in a rising, clockwise direction) with respect to the neck flanges 134 of the sent bracket engaging neck 132 of the lock housing 118; in fact, the neck flanges 134 are right behind (in the rising, clockwise direction) and adjacent to the protrusions 138. In addition, a rotational gap 140 exists between each protrusion 138 and the following neck flange 134 (in the rising, clockwise direction).

Figure 8A:
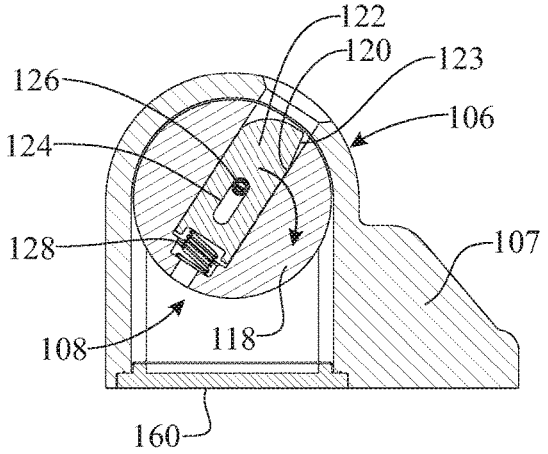
FIG. 8A presents a transverse cross-sectional view of the base element and seat raising mechanism with the lock pin illustrated in an unlocking position in the lock housing of the mechanism upon actuation of the seat actuation button to raise the toilet seat.
Figure 8B:
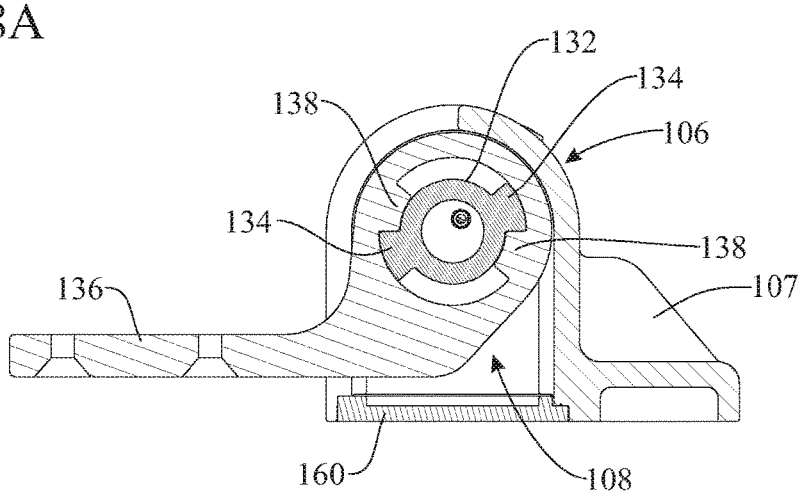
FIG. 8B presents a transverse cross-sectional view of the base element and seat bracket with the seat bracket in a lowered position.
Figure 8C:
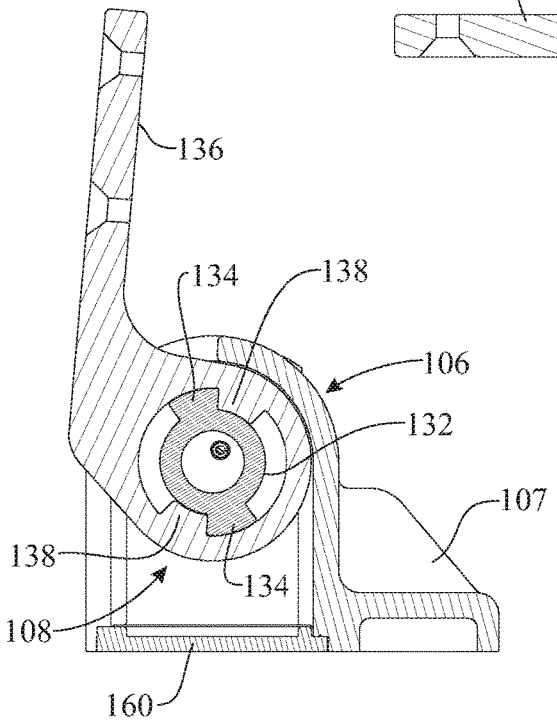
FIG. 8C presents a transverse cross-sectional view of the base element and seat bracket with the seat bracket in a raised position upon lifting of the toilet seat by actuation of the seat actuation button.

Starting from the initial position of FIGS. 7A and 7B (or 8B), and with the toilet lid 142 in the raised position, the seat actuation button 154 on the toilet lid 142 may be depressed to automatically raise the toilet seat 102 from the toilet bowl. Accordingly, the button rod 152 pivots the rod link 150, which depresses the pin actuating rod 146 against the rod return spring 148. The pin actuating rod 146 inserts through the lock pin opening 168 in the base element 106 and actuates the lock pin 122 from the initial locking position (FIG. 7A) to the unlocking position (FIG. 8A) against the lock pin compression spring 128, clearing the lock pin opening 168 such that the torsion spring 116 rotates the lock housing 118 from the lowered seat position to the raised seat position. Thus, as illustrated in FIGS. 8B and 8C, the neck flanges 134 of the seat bracket engaging neck 132 of the rotating lock housing 118 engage and push the protrusions 138 of the seat bracket 136 in an upward direction (clockwise, in the present figures), and thus the rotating lock housing 118 rotates the seat bracket 136, which raises the attached toilet seat 102. The first damper 180 dampens the upward pivoting of the toilet seat 102 with respect to the base element 106 (which is fixed), causing the toilet seat 102 to rise slowly and controlledly. Upon release of the seat actuation button 154, the rod return spring 148 rises and removes the pin actuating rod 146 from the lock pin opening 168.

After use of the toilet, the user may manually lower the toilet seat 102 and cause the lock housing 118 to rotate from the raised seat position (FIG. 8C) back to the lowered seat position (FIG. 8B). As understood from FIGS. 8C and 8B, the protrusions 138 of the seat bracket 136 now engage and push the neck flanges 134 of the seat bracket engaging neck 132 of the rotating lock housing 118 in a downward angular direction (counterclockwise in the present figures), and thus the seat bracket 136 rotates the rotating lock housing 118 and eventually brings it back to the locking position of FIG. 7A. As soon as the lock pin cavity 120 and the lock pin opening 168 are realigned, the lock pin 122 is freed to move from the unlocking position to the locking position due to the expansive force of the lock pin compression spring 128, so that the lock pin 122 again protrudes through the lock pin opening 168. The beveled lock pin surface 123 on the lock pin 122 helps guide the lock pin 122 towards the lock pin opening 168, as it allows the lock pin 168 to move towards the lock pin opening 168 in the event of a slight misalignment between the lock pin cavity 120 and the lock pin opening 168. Further, the beveled edge of the lock pin surface 123 allows the pin to smoothly transition from the lowered seat configuration to the raised seat configuration in response to the seat actuation button 154 being pressed.

Figure 7C:
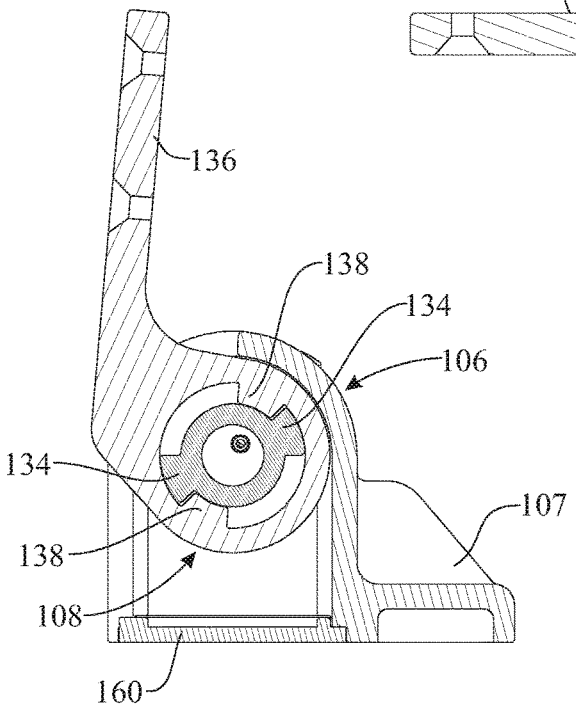
FIG. 7C presents a transverse cross-sectional view of the base element and seat bracket with the seat bracket in a raised position upon manual lifting of the toilet seat.

The toilet seat and lid assembly 100 of the present embodiment also provides for the toilet seat 102 to be able to be raised manually if desired. The user can raise the toilet seat 102 normally, without having to depress the seat actuation button 154. For instance, a user can start from the initial position of FIGS. 7A and 7B (or 8B), in which the toilet lid 142 is in a raised position and the toilet seat 102 is in a lower position, and in which the lock pin 122 is locked to the lock pin opening 168 and prevents the lock housing from rotating 118. From this initial lock position, manual lifting of the toilet seat 102 causes the seat bracket 136 to rotate in the upward direction (clockwise, in the figures). Because the protrusions 138 of the seat bracket 136 are arranged rotationally advanced (in the upward, rising, clockwise direction) with respect to the neck flanges 134 of the seat bracket engaging neck 132 of the lock housing 118 (which is locked in place by the lock pin 122), the seat bracket 136 can rotate upward while the protrusions 138 travel along the gap 140. When the protrusions 138 contact the next neck flange 134, as shown in FIG. 7C, the seat bracket 136 (and thus the toilet seat 102) stop rising. The angular dimension of the gap 140 thus defines the maximum pivoting angle of the seat bracket 136 toilet seat 102, and is configured so that, in the final position of FIG. 7C, the toilet seat 102 is in an elevated position substantially adjacent to the elevated toilet lid 142. After use of the toilet, the user may manually lower the toilet seat 102.

As another exemplary description, disclosed is a seat lifting mechanism for lifting a toilet seat without touching the toilet seat, the seat lifting mechanism comprising, a base configured to rotate a toilet seat between a lowered seat position and a raised seat position, where the toilet seat may be biased to the raised position and selectively lockable in the lowered position. The toilet seat may be spring biased to the raised position, and the toilet seat may be selectively lockable in the lowered position. The seat lifting mechanism includes an actuation structure that may be selectively displaceable to cause the toilet seat to become released from the lowered position to be rotated to the raised position due to the spring bias. The seat lifting mechanism includes a toilet lid, and the actuation structure may be displaceable upon actuating an actuation button disposed on the toilet lid. The actuation structure includes a pin that may be configured to lock into an opening in the base for locking the toilet seat in the lowered position. The seat lifting mechanism includes at least one damper for dampening a rotational force applied by the seat when the seat is rotated between the lowered position and the raised position and between the raised position and the lowered position.

The dampers shown in FIGS. 1-8 have anti-rotation features (182 and 192) along an outer diameter of a cylindrical body of each of the dampers. A small rectangular groove in the base captures the anti-rotation features in the groove so that the dampers do not turn as the lid or the seat is rotated, respectively. The dampers are non-rotatable relative to the base element 106. The rectangular protrusions (e.g. 194 and 184) on the end of the dampers engage the seat and lid respectively to slow the seat and lid down so that the seat and lid do not slam the bowl.

Figure 9:
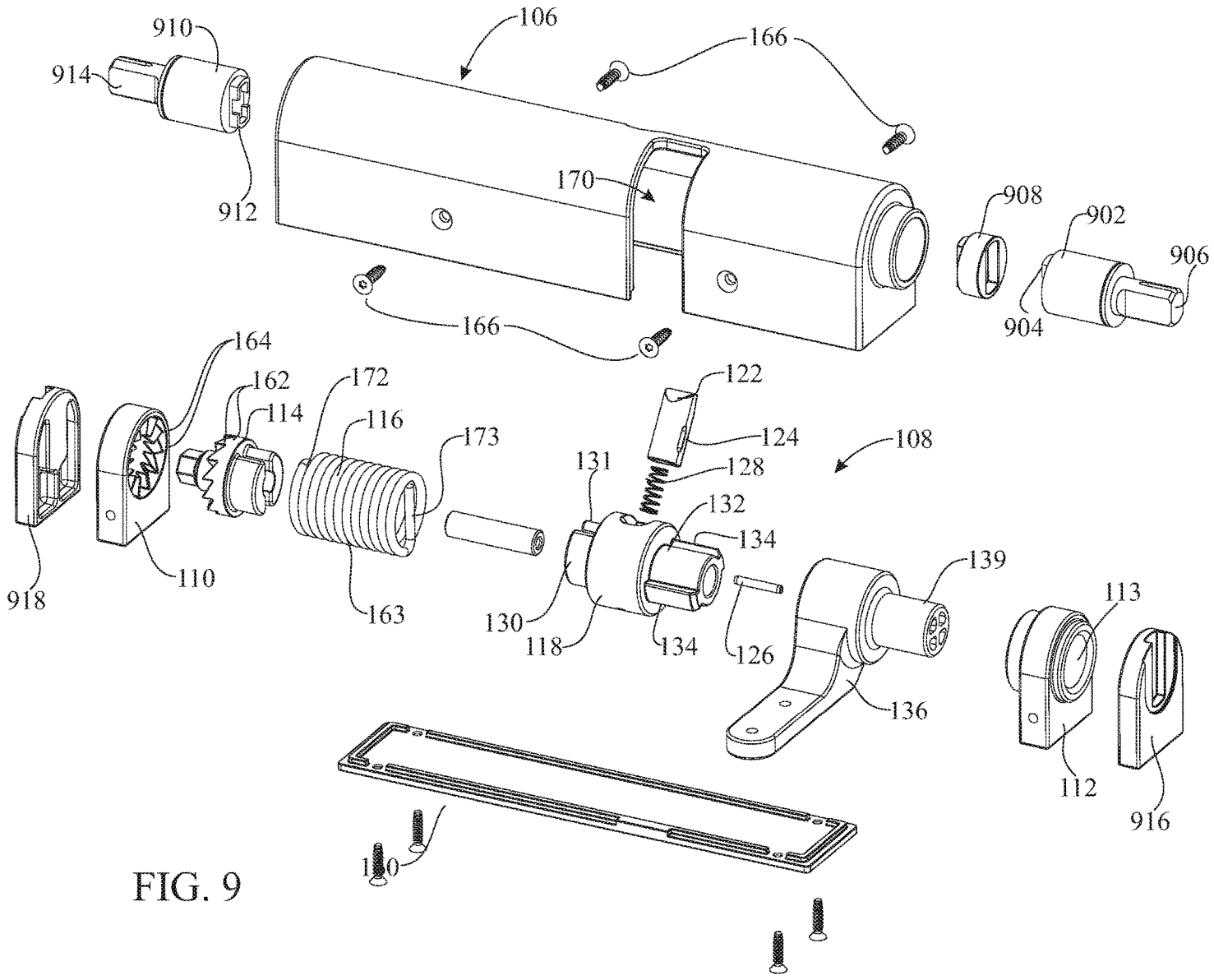
FIG. 9 presents an exploded front top perspective view of the base element of the toilet seat and lid assembly, revealing a variation in the seat raising mechanism of the toilet seat and lid assembly.
Figure 10:
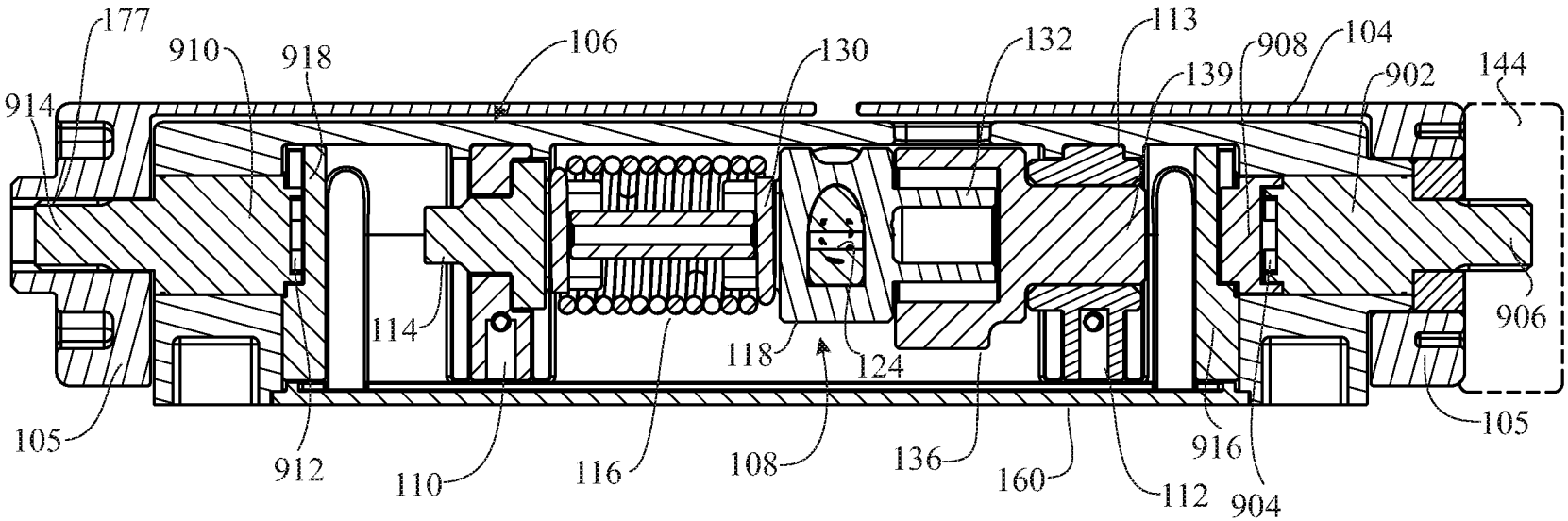
FIG. 10 presents a longitudinal cross-sectional view of the base element with the seat raising mechanism of FIG. 9 mounted inside the base element, taken along a similar sectional plane as plane 6-6 indicated in FIG. 2.

Further, a variation on the damper arrangement is disclosed and anticipated as shown in FIGS. 9 and 10.

For example, FIGS. 9 and 10 include all of the same elements and their relations as described above, but the dampers instead are noted as dampers 902 and 910 having an alternative retaining arrangement. Damper 902 includes an adapter connection structure 904 that is configured to connect to adapter 908 such that the adapter connection structure 904 remains fixed relative to the adapter 908. Damper 902 includes an end portion 906 which performs the same functions as described above with respect to end portion 194. For example, the end portion 906 may non-rotatably connect to toilet lid flange 144. The adapter 908 may include a retainer connection structure for being non-rotatably connected to retainer 916 for retaining the damper 902 fixed with respect to the base element 106 (e.g. the retainer 916 may be fixed relative to the base element 106 as shown in the figures). The damper 902 may dampen rotational forces as described above, and the end portion 906 may dampingly rotate upon being subjected to rotational forces. For example, the dampers may apply resistive force countering rotational force applied to the dampers. The adapter 908 may extend the damper 902 such that the damper 902 reaches the lid flange 144.

Damper 910 may similarly include the various structures and functions as adapter 902. However, in some versions the damper 910 does not necessarily need to connect to a retainer (e.g. since the damper 910 does not need to extend all the way to the lid flange 144). For example, damper 910 is directly non-rotatably connected to side portion 105. Damper 910 may include a retainer connection structure 912 which may be similar or identical to the adapter connection structure 904 of damper 902, where the retainer connection structure 912 is configured to non-rotatably connect to retainer 918 as shown in FIGS. 9 and 10.

Therefore, the variation of the dampers shown in FIGS. 9 and 10 allow the assembly 100 to function as described above without requiring longitudinal ribs 182 and 192, since the retainers (and/or adapter) perform the function of non-rotatably retaining the dampers for allowing the dampers to dampen rotational forces applied to the dampers by either the seat or the lid. For example, as described above with respect to the dampers 180 and 190, one damper may be configured to dampen rotational forces received by the lid, and one damper may be configured to dampen rotational forces received by the seat. It is to be understood that like elements shown in FIGS. 1-8 and their descriptions also apply to like elements of FIGS. 9 and 10.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A seat raising mechanism for lifting a toilet seat without touching the toilet seat, the seat raising mechanism comprising:

a base containing a seat raising mechanism configured to rotate a toilet seat between a lowered seat position and a raised seat position, where the toilet seat is biased to the raised position and selectively lockable in the lowered position;

a toilet lid;

the toilet seat pivotally arranged with respect to the toilet lid; and wherein the seat raising mechanism further includes a lock housing rotatable between the lowered seat position and a raised seat position;

wherein the seat raising mechanism further includes:

a lock pin cavity in the lock housing;

a spring-loaded lock pin disposed for displacement in the lock pin cavity between a locking position and an unlocking position;

a seat bracket engaged for rotation by the lock housing and engaging the toilet seat; and a torsion spring biasing the lock housing towards the raised seat position;

wherein the seat raising mechanism further includes a pin actuating rod carried by the toilet lid, the pin actuating rod engaging the lock pin for actuation of the lock pin from the locking position to the unlocking position;

wherein a seat actuation button is carried by the toilet lid and engages the pin actuating rod;

wherein the seat raising mechanism further includes a lock pin compression spring configured to bias the lock pin in the locking position in the lock pin cavity; and wherein the lock pin is mounted on a pin axle which extends through an elongated axle slot in the lock pin.

2. The seat raising mechanism of claim 1, wherein the seat raising mechanism includes at least one damper for dampening a rotational force applied by the seat when the seat is rotated between the lowered position and the raised position and between the raised position and the lowered position.

3. A toilet seat and lid assembly, the assembly comprising:

a toilet lid;

a toilet seat pivotally arranged with respect to the toilet lid; and a seat raising mechanism for automatically raising the toilet seat;

wherein the seat raising mechanism further includes a lock housing rotatable between a lowered seat position and a raised seat position;

wherein the seat raising mechanism further includes:

a lock pin cavity in the lock housing;

a spring-loaded lock pin disposed for displacement in the lock pin cavity between a locking position and an unlocking position;

a seat bracket engaged for rotation by the lock housing and engaging the toilet seat; and a torsion spring biasing the lock housing towards the raised seat position;

wherein the seat raising mechanism further includes a pin actuating rod carried by the toilet lid, the pin actuating rod engaging the lock pin for actuation of the lock pin from the locking position to the unlocking position;

wherein a seat actuation button is carried by the toilet lid and engages the pin actuating rod;

wherein the seat raising mechanism further includes a lock pin compression spring configured to bias the lock pin in the locking position in the lock pin cavity; and wherein the lock pin is mounted on a pin axle which extends through an elongated axle slot in the lock pin.

4. The assembly of claim 3, wherein the seat raising mechanism is contained inside a base element between the toilet seat and the toilet lid.

5. The assembly of claim 3, wherein the seat actuation button is configured to engage a button rod which engages a rod link pivotably connected to the pin actuating rod.

6. The assembly of claim 5, wherein the seat raising mechanism further comprises a cover configured to conceal the pin actuating rod, the rod link and the button rod on the toilet lid.

7. The assembly of claim 6, wherein the torsion spring is mounted between a spring mount and a spring retainer which extends from the lock housing.

8. The assembly of claim 7, wherein the spring mount has multiple spring mount teeth which are configured to mesh with companion side support teeth on a side support of the seat raising mechanism.

9. A toilet seat and lid assembly, the assembly comprising:

a toilet lid;

a toilet seat pivotally arranged with respect to the toilet lid; and a seat raising mechanism for automatically raising the toilet seat;

wherein the seat raising mechanism further includes a lock housing rotatable between a lowered seat position and a raised seat position;

wherein the seat raising mechanism further includes:

a lock pin cavity in the lock housing;

a spring-loaded lock pin disposed for displacement in the lock pin cavity between a locking position and an unlocking position;

a seat bracket engaged for rotation by the lock housing and engaging the toilet seat; and a torsion spring biasing the lock housing towards the raised seat position;

wherein the seat raising mechanism further includes a pin actuating rod carried by the toilet lid, the pin actuating rod engaging the lock pin for actuation of the lock pin from the locking position to the unlocking position;

wherein a seat actuation button is carried by the toilet lid and engages the pin actuating rod;

wherein the seat raising mechanism further includes a lock pin compression spring configured to bias the lock pin in the locking position in the lock pin cavity;

wherein the lock pin is mounted on a pin axle which extends through an elongated axle slot in the lock pin; and wherein the seat actuation button is configured to engage a button rod which engages a rod link pivotably connected to the pin actuating rod.

* * * * *